US009382692B2

(12) United States Patent
Sakatani et al.

(10) Patent No.: US 9,382,692 B2
(45) Date of Patent: Jul. 5, 2016

(54) SEAT STAND AND WORKING MACHINE INCLUDING SAME

(71) Applicant: KOBELCO CONSTRUCTION MACHINERY CO., LTD., Hiroshima-shi (JP)

(72) Inventors: Masanori Sakatani, Hiroshima (JP); Yukio Hiraoka, Hiroshima (JP); Keiji Yamamoto, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 125 days.

(21) Appl. No.: 14/297,936

(22) Filed: Jun. 6, 2014

(65) Prior Publication Data

US 2014/0367534 A1 Dec. 18, 2014

(30) Foreign Application Priority Data

Jun. 13, 2013 (JP) ..... 2013-124383

(51) Int. Cl.

| | |
|---|---|
| ***E02F 9/16*** | (2006.01) |
| ***E02F 9/20*** | (2006.01) |
| ***E02F 3/32*** | (2006.01) |
| ***E02F 9/22*** | (2006.01) |

(52) U.S. Cl.

CPC . *E02F 9/16* (2013.01); *E02F 3/325* (2013.01); *E02F 9/2004* (2013.01); *E02F 9/2275* (2013.01)

(58) Field of Classification Search

CPC ..... E02F 9/16; E02F 3/325; E02F 9/2275; E02F 9/2004

USPC ..... 180/89.12; 296/190.08

See application file for complete search history.

(56) References Cited

U.S. PATENT DOCUMENTS 8,038,202 B2 * 10/2011 Ueda ..... E02F 9/163 296/190.01
2008/0035401 A1 * 2/2008 Ishii ..... E02F 3/325 180/89.12

(Continued)

FOREIGN PATENT DOCUMENTS

| | | |
|---|---|---|
| EP | 2 557 237 A1 | 2/2013 |
| JP | 2-70056 U | 5/1990 |
| JP | 2005-105591 | 4/2005 |
| JP | 2005-255109 A | 9/2005 |

(Continued)

OTHER PUBLICATIONS

Extended European Search Report issued Oct. 20, 2014 in Patent Application No. 14172078.9.

*Primary Examiner* — Ruth Ilan

(74) *Attorney, Agent, or Firm* — Oblon, McClelland, Maier & Neustadt, L.L.P

(57) ABSTRACT

A seat stand includes a seat support section including an installation plate portion having an upper surface on which a seat is provided and an left control box support section extending from a seat support section to the left side of the seat and supporting a left control box. The left control box support section includes an extension portion extending sideward from the installation plate portion and including an upper surface on which the left control box is supported. A arranging space is provided under the extension portion in such a manner that a connection line extending from the left control box supported on the extension portion is arranged through the arranging space. A cutout portion, formed in the extension portion, penetrates the extension portion in a vertical direction and is open sideward.

12 Claims, 7 Drawing Sheets

(56) References Cited

U.S. PATENT DOCUMENTS

| | | | | |
|---|---|---|---|---|
| 2012/0144798 | A1* | 6/2012 | Brumberg | E02C 5/11 60/247 |
| 2013/0017048 | A1 | 1/2013 | Kimura et al. | |
| 2015/0115657 | A1* | 4/2015 | Hiraoka | E02F 9/16 296/190.01 |
| 2015/0115659 | A1* | 4/2015 | Kurushima | E02F 3/325 296/190.08 |

FOREIGN PATENT DOCUMENTS

| | | | | |
|---|---|---|---|---|
| JP | 2005-282110 | A | | 10/2005 |
| JP | 2007-303213 | A | | 11/2007 |
| JP | 2009-24395 | A | | 2/2009 |
| JP | 2010-24715 | | | 2/2010 |
| JP | 2010-24715 | A | * | 2/2010 |
| JP | 2021-36672 | A | * | 2/2012 |
| WO | WO 2005/083186 | A1 | * | 9/2005 |

* cited by examiner

SEAT STAND AND WORKING MACHINE INCLUDING SAME

BACKGROUND OF THE INVENTION

1. Field of the Invention

The present invention relates to a working machine such as a hydraulic shovel, and in particular, to a configuration that supports, at the side of a seat, an operating apparatus allowing a working apparatus such as an attachment to be operated.

2. Description of the Related Art

In general, in working machines, for example, an operating lever (operating apparatus) allowing a bucket or the like (working apparatus) to be operated is located at the side of a seat.

For example, a working machine described in Japanese Utility Model Application Laid-open No. H2-70056 (hereinafter it is called patent literature 1) includes a seat, a pair of control boxes in which the control boxes are located at laterally opposite sides of the seat so as to stand from a floor surface, a pair of operating levers (operating apparatuses) in which the operating levers are assembled to the respective control boxes, and a cutoff lever (operating apparatus) assembled to the left control box.

During operation of the working machine, the cutoff lever projects from the left control box toward a loading/unloading passage. On the other hand, in getting on and off the working machine, an operator rotates the cutoff lever and retracts the cutoff lever from the loading/unloading passage. Such rotation of the cutoff lever switches a hydraulic circuit allowing the working apparatus to be driven.

Furthermore, a construction machine described in Japanese Patent Application Laid-open No. 2005-105591 (hereinafter it is called patent literature 2) includes a seat stand allowing an operator's seat (seat) to be supported, a support plate mounted on a side surface of the seat stand, and a control box (operating apparatus) having a rear portion supported by the support plate.

The control box is provided with a loading/unloading cutoff lever and an operating lever.

The control box is supported by the support plate so that the loading/unloading cutoff lever is operationally moved upward to rotate the control box from a working locked position where the control box is substantially horizontally located to an unloading flipped-up position where a front portion of the control box is raised.

In this case, the operating apparatus is connected, via a connection line including at least either hydraulic hose or electric wiring, to a hydraulic apparatus or a control apparatus to allow the working apparatus to be operated.

Furthermore, the operating apparatus faces an operation space, and thus, the esthetic aspect of the operating apparatus is also important.

Thus, a support structure allowing the operating apparatus to be supported needs to have not only a portion that supports the operating apparatus but also an arranging (routing) space through which the connection line is efficiently and appropriately arranged.

In this regard, the working machine described in the patent literature 1 has a arranging space provided in the control box and through which hydraulic piping connected to the operating lever and the cutoff lever is arranged. However, the arranging space is enclosed by the control box, making assembly of both levers to the control box and arranging of the connection line connected to both levers difficult.

Furthermore, the construction machine according to the patent literature 2 allows the control box to be relatively easily assembled to the seat stand by assembling the control box to the support plate.

However, the patent literature 2 fails to disclose the connection line connected to the control box. The constriction machine descried in the patent literature 2 fails to take into account the arranging space through which the connection line is arranged.

SUMMARY OF THE INVENTION

An object of the present invention is to provide a working machine including a seat stand that enables an increase in the efficiency of an assembly operation for an operating apparatus including arranging of a connection line and a working machine including the seat stand.

In order to solve the problem, the present invention provides a seat stand configured to support, at a side of a seat, an operating apparatus causing a working apparatus provided in a working machine to be operated, the seat stand including: a seat support section including an installation plate portion having an upper surface on which the seat is provided; and an operating apparatus support section extending from the seat support section to the side of the seat and configured to support the operating apparatus, wherein the operating apparatus support section has an extension portion extending sideward from the installation plate portion and having an upper surface configured to support the operating apparatus thereon, an arranging space is provided under the extension portion in such a manner that a connection line extending from the operating apparatus supported on the extension portion is arranged through the arranging space, and a cutout portion, formed in the extension portion, penetrates the extension portion in a vertical direction and is open sideward.

Furthermore, the present invention provides a working machine including a working apparatus, an operating apparatus allowing the working apparatus to be operated, and a seat stand supporting the operating apparatus at a side of a seat.

The working machine according to the preset invention enables an increase in the efficiency of an assembly operation for the operating apparatus including arranging of a connection line.

DESCRIPTION OF THE EMBODIMENTS

An embodiment of the present invention will be described below with reference to the drawings. The embodiment below is a specific example of the present invention and is not intended to limit the technical scope of the present invention. Furthermore, unless otherwise specified, the description below uses directions as viewed by an operator sitting in a seat (illustrated directions).

Figure 1:
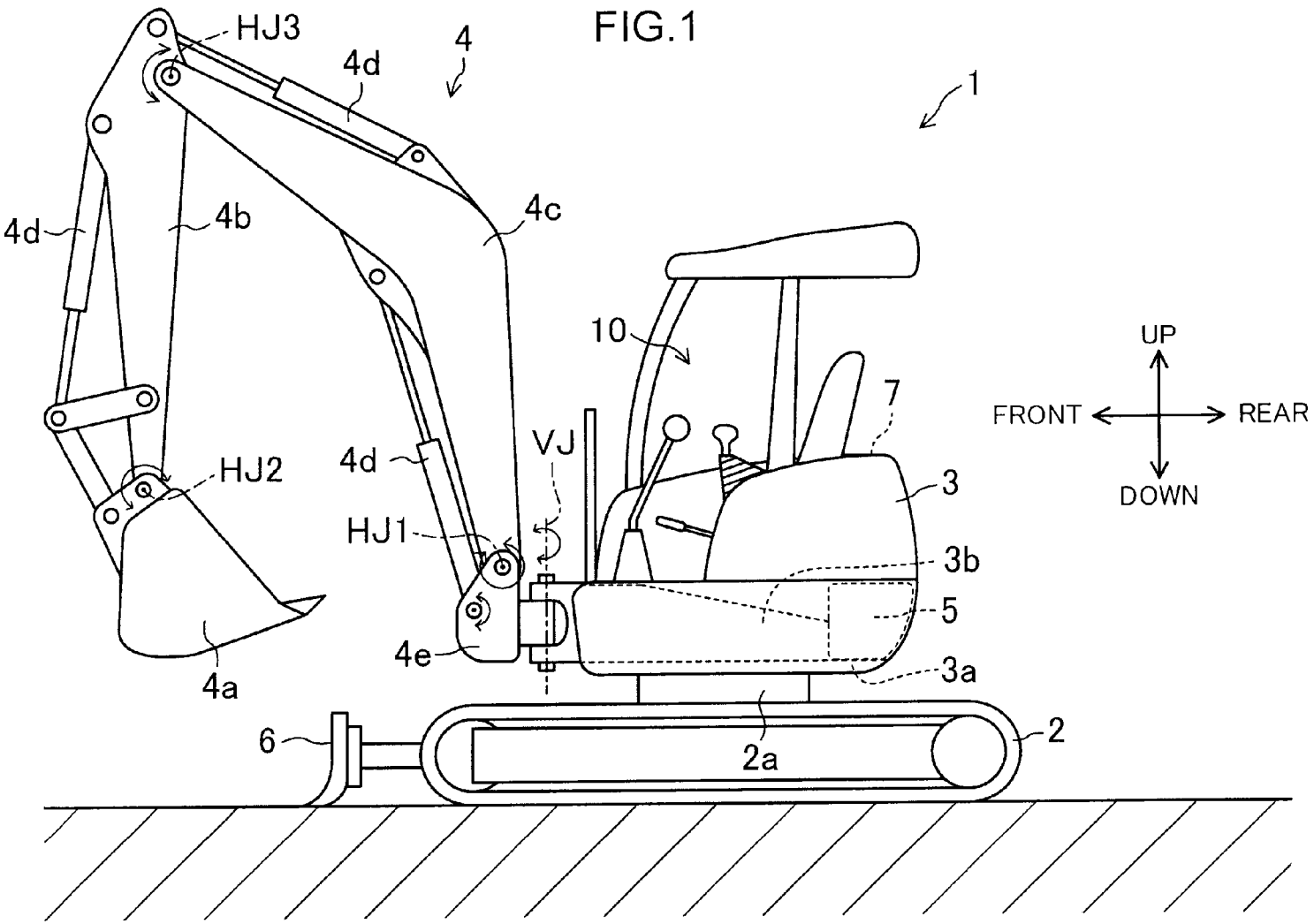
FIG. 1 is a schematic side view showing a hydraulic shovel according to an embodiment of the present invention.

FIG. 1 shows a hydraulic shovel 1 as an example of a working machine according to the present invention. The hydraulic shovel 1 is small in size and is of a rearward small-swing-radius type. Furthermore, the hydraulic shovel 1 includes a lower traveling body 2 of a crawler type and an upper slewing body 3 provided on the lower traveling body 2 so as to able to slew relative to the lower traveling body 2.

A support frame 3*a* is located at a lower portion of the upper slewing body 3 and has a bottom plate serves as a base and members such as various brackets, a frame, and a plate which are assembled to the bottom plate. The support frame 3*a* is supported so as to be able to slew via a slewing bearing 2*a* relative to the lower traveling body 2. The support frame 3*a* has an attachment 4 (an example of a working apparatus) provided at a front end portion of the support frame 3*a*.

Specifically, the attachment 4 is supported at a front end of a vertical plate 3*b* standing on the support frame 3*a*.

The attachment 4 includes a swing bracket 4*e* mounted to the vertical plate 3*b* so as to be able to swing around a vertical axis VJ, a boom 4*c* having a base end portion mounted to the swing bracket 4*e* so as to be rotatable around a horizontal axis HJ1, an arm 4*b* having a base end portion mounted to the boom 4*c* so as to be rotatable around a horizontal axis HJ3, and a bucket 4*a* mounted to the arm 4*b* so as to be rotatable around a horizontal axis HJ2. The vertical axis VJ is an axis perpendicular to the ground. The horizontal axes HJ1 to HJ3 are axes orthogonal to the vertical axis VJ and parallel to one another.

Furthermore, the attachment 4 includes a plurality of hydraulic cylinders 4*d*. Specifically, the hydraulic cylinders 4*d* include a swing cylinder (not shown in the drawings) allowing the swing bracket 4*e* to swing relative to the support frame 3*a*, a boom cylinder allowing the boom 4*c* to rise and lower relative to the swing bracket 4*e*, an arm cylinder allowing the arm 4*b* to rotate relative to the boom 4*c*, and a bucket cylinder allowing the bucket 4*a* to rotate relative to the arm 4*b*.

The hydraulic shovel 1 allows the attachment 4 to be driven by operating levers 13R and 13L. To keep the hydraulic shovel 1 in balance in a front-rear direction with respect to a possible load on the attachment 4, the upper slewing body 3 includes a heavy counterweight 5 installed at a rear portion of the vertical plate 3*b*.

A dozer 6 (an example of a working apparatus) used for an excavating operation or the like is provided on a front side of the lower traveling body 2. The dozer 6 is provided on the lower traveling body 2 so as to be able to rise and lower around an axis parallel to the horizontal axes HJ1 to HJ3. In this case, the dozer 6 can also be driven by operating a dozer lever 15 described below.

A machine room 7 is provided in an area ranging from a right portion to a rear portion of the upper slewing body 3. The machine room 7 houses an engine, a hydraulic apparatus, a fuel tank, a hydraulic oil tank, and the like, none of which is shown in the drawings. An operation space 10 is provided in a front left portion of the upper slewing body 3 (the upper slewing body 3 except for the machine room 7). The operation space 10 is overlapped from above with a hood. That is, the operation space 10 according to the present embodiment is open sideward.

Figure 2:
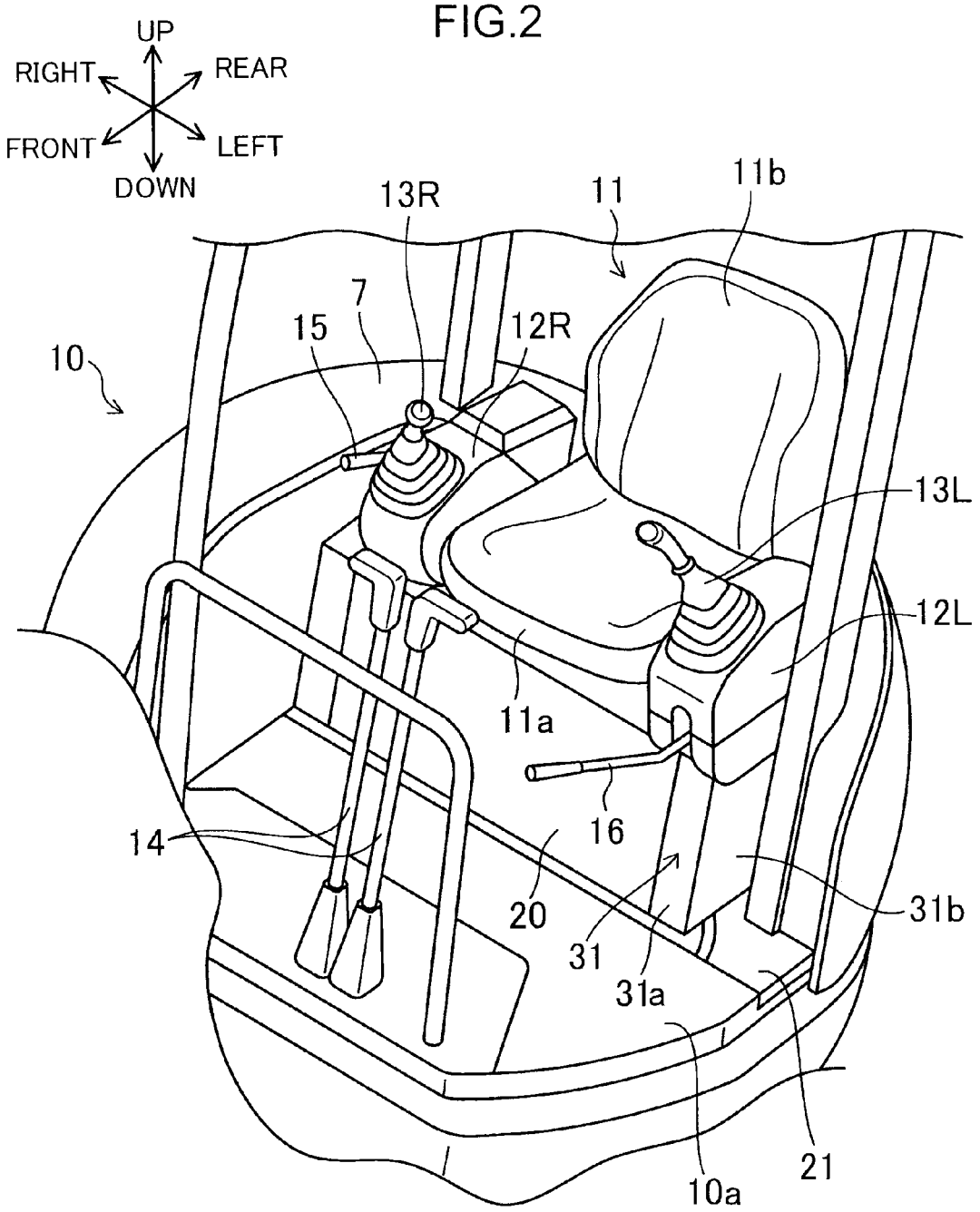
FIG. 2 is a schematic perspective view showing a configuration provided in an operation space shown in FIG. 1.

FIG. 2 shows a configuration provided in the operation space 10. A seat 11 and operating apparatuses are provided in the operation space 10. The operating apparatuses includes a pair of traveling levers 14, a left control box 12L and a right control box 12R, a left operating lever 13L and a right operating lever 13R, a dozer lever 15, and a flip-up lever 16.

The seat 11 has a seat portion 11*a* in which an operator sits, and a backrest portion 11*b* against which the operator's back is pressed. The seat portion 11*a* is mounted on a seat stand 20 described below. The control boxes 12L and 12R are located adjacently to the seat 11 on the left and right thereof, respectively, and mounted on the seat stand 20.

The seat stand 20 is a stand-like frame portion provided in the operation space 10. The seat stand 20 extends in a lateral direction in a rear portion of the operation space 10. The seat stand 20 will be described below in detail.

The left and right operating levers 13L and 13R are provided in the left and right control boxes 12L and 12R, respectively. The attachment 4 can be driven by operating the operating levers 13L and 13R.

The flip-up lever 16 is provided in the left control box 12L.

Figure 3:
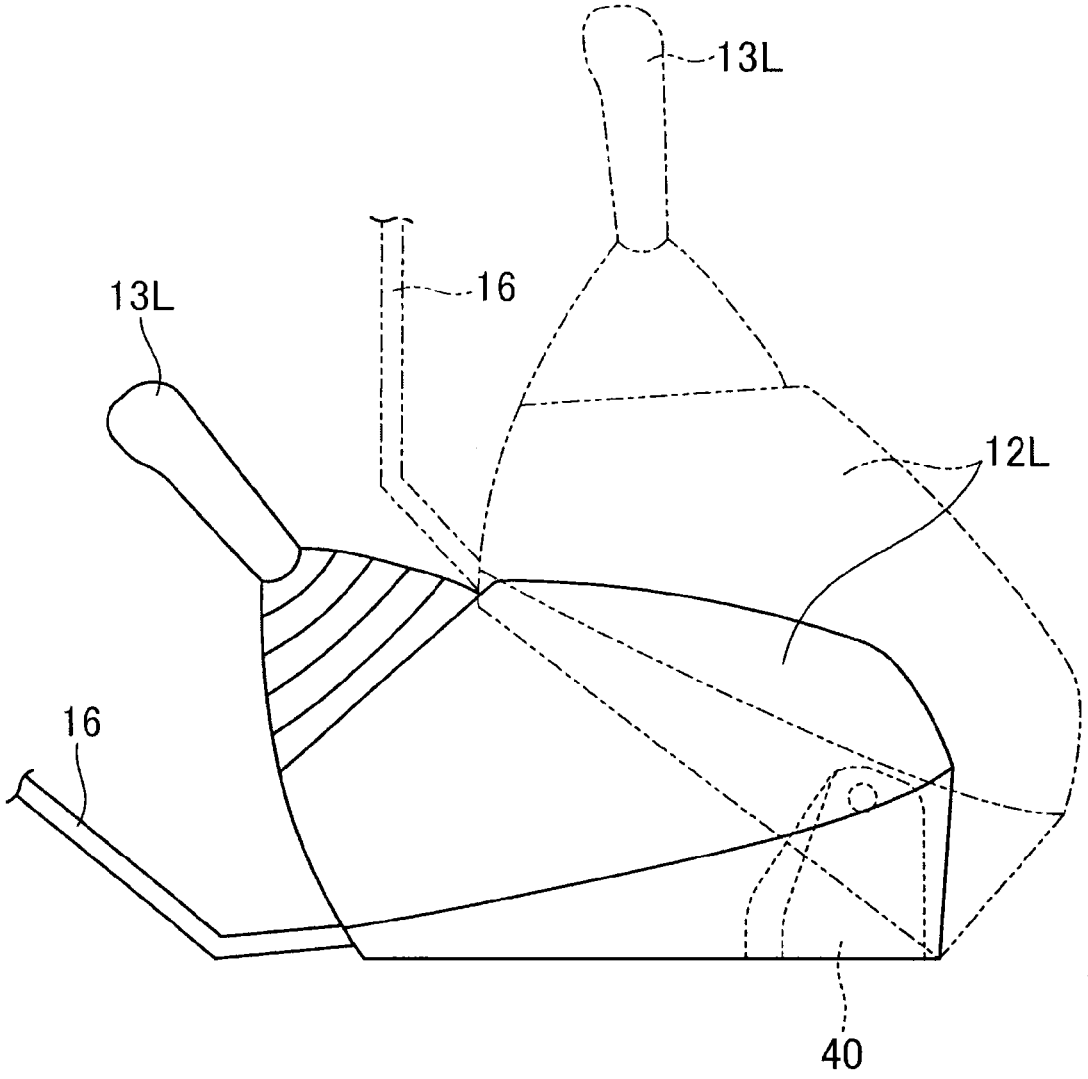
FIG. 3 is a schematic side view illustrating movement of a control box.

In this case, a rear end portion (base end portion) of the left control box 12L is supported by a bracket 40 attached to the seat stand 20 so as to be rotatable between an operating orientation (basic orientation) shown by a solid line in FIG. 3 and a non-operating orientation (stand-up orientation) shown by an imaginary line in FIG. 3. In the operating orientation, the left control box 12L is substantially horizontally oriented. On the other hand, in the non-operating orientation, the left control box 12L is inclined so that a front end portion (leading end portion) of the left control box 12L lies upward.

With the left control box 12L placed in the operating orientation, the flip-up lever 16 extends forward from the left control box 12L so as to block a loading/unloading passage extending leftward from the front of the seat 11.

In this state, the flip-up lever 16 is operationally moved upward to flip up the left control box 12L from the operating orientation to the non-operating orientation. In other words, the left control box 12L rotates so that the front end portion moves upward relative to the operating orientation.

Thus, the flip-up lever 16 is placed in an upper portion of the left control box 12L to open the loading/unloading passage. Consequently, by rotating the left control box 12L to the non-operating orientation, the operator can easily enter or exit the operation space 10.

Furthermore, the hydraulic circuit is switched by operating the flip-up lever 16 so as to rotate the left control box 12L to the non-operating orientation. For example, the hydraulic circuit is switched so as to inhibit driving of the attachment 4 in spite of operation of the operating levers 13R and 13L. For implementation of this function, at least either hydraulic hose or electric wiring is connected to the flip-up lever 16.

The hydraulic shovel 1 is designed such that the left control box 12L can be efficiently assembled. A structure allowing the left control box 12L to be assembled will be described below in detail.

Figure 4:
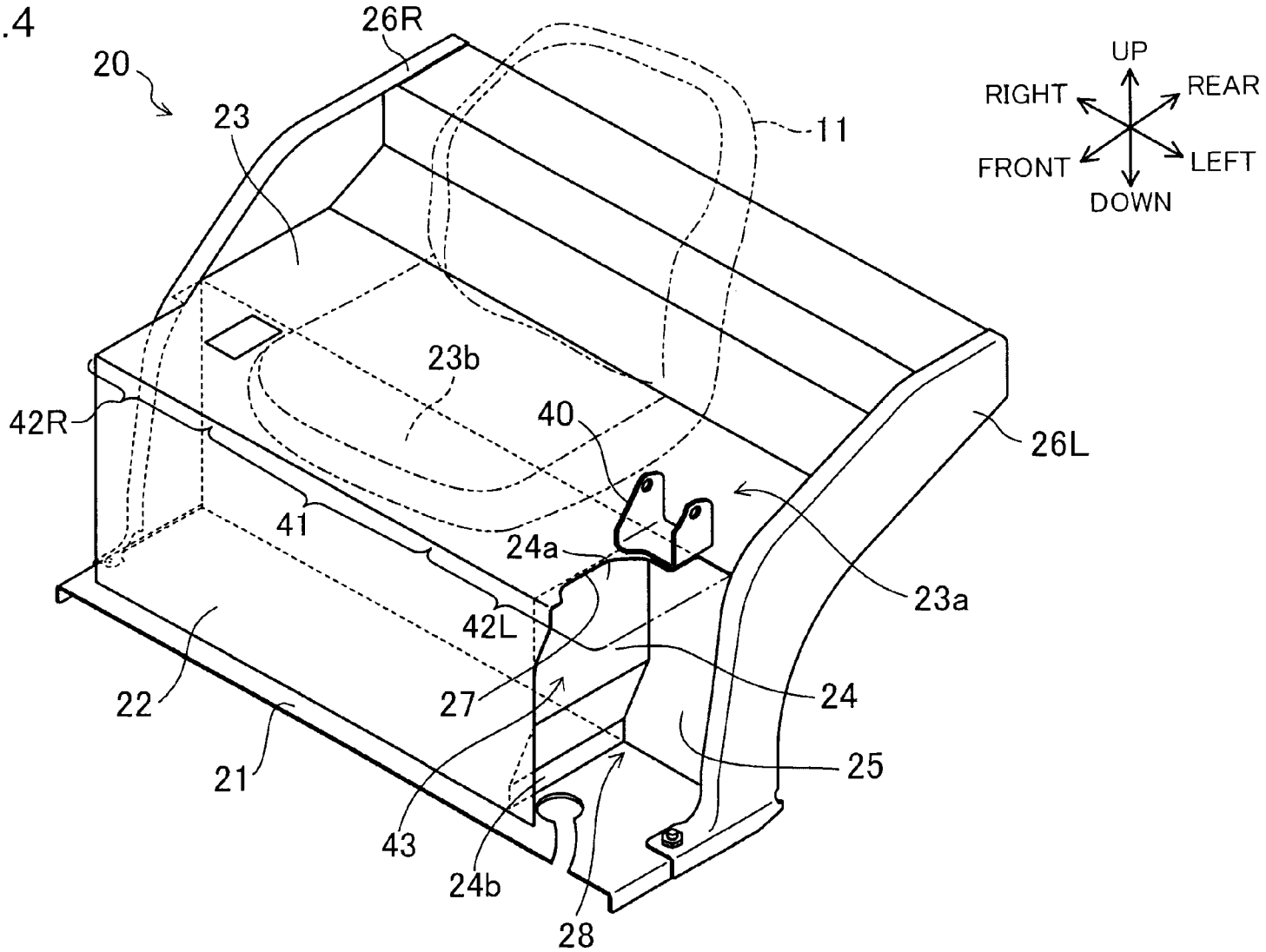
FIG. 4 is a schematic perspective view showing a seat stand from which the control box has been removed.

The seat stand 20 is a component assembled to the support frame 3*a*. Specifically, as shown in FIG. 4, the seat stand 20 includes a bottom plate portion 21, a front plate portion 22, a top plate portion 23, a lower side plate portion 24, a connected plate portion 25, and side frame portions 26L and 26R, all of which are integrally coupled together. The whole seat stand 20 except for the side frame portions 26L and 26R is formed of a steel plate.

The bottom plate portion 21 is formed using a generally rectangular plate member extending in the lateral direction. As shown in FIG. 2, the bottom plate portion 21 is assembled to the support frame 3*a* behind a floor member 10*a* of the operation space 10 with a thickness direction of the bottom plate portion 21 extending along the vertical direction.

The front plate portion 22 is formed using a generally rectangular plate member extending in the lateral direction and having a longitudinal dimension smaller than the bottom plate portion 21. The front plate portion 22 is arranged along a front edge of the bottom plate portion 21. The front plate portion 22 includes a lower end portion joined to an upper surface of the bottom plate portion 21. The front plate portion 22 stands from the upper surface of the bottom plate portion 21 with a thickness direction of the front plate portion 22 extending along the front-rear direction (with a front surface of the front plate portion 22 facing the operation space).

The top plate portion 23 is formed using a plate member extending rearward from an upper end portion of the front plate portion 22. The front plate portion 22 and the top plate portion 23 are formed by folding a single plate member. The top plate portion 23 is arranged substantially parallel to the bottom plate portion 21. The top plate portion 23 and the bottom plate portion 21 lie opposite each other in the vertical direction. The seat 11 is provided in a laterally intermediate area of an upper surface of the top plate portion 23.

On the left of the seat 11 and under the top plate portion 23, the lower side plate portion 24 extends in the front-rear direction. Specifically, the lower side plate portion 24 is located between the front plate portion 22 and the connected plate portion 25 with a thickness direction of the lower side plate portion 24 extending along the lateral direction.

The connected plate portion 25 is arranged under the top plate portion 23 opposite the front plate portion 22 in the front-rear direction and substantially parallel to the front plate portion 22.

The side frame portions 26L and 26R are provided at the left portion and right portion of the seat stand 20. Furthermore, the side frame portions 26L and 26R are each a strength member which has a front end located below a rear end and which is curved so as to protrude upward. Left end portions of the bottom plate portion 21, top plate portion 23, and connected plate portion 25 are joined to the left side frame portion 26L. Right end portions of the bottom plate portion 21, top plate portion 23, and crossing plate portion 25 are joined to the right side frame portion 26R.

In this case, the seat stand 20 is functionally partitioned into a seat support section 41, a right box support section 42R, a left box support section 42L, and a bottom plate portion 21. The seat support section 41 is a section allowing the seat 11 to be supported. The right box support section 42R is a section extending from the seat support section 41 to the right side of the seat 11 in order to support the right control box 12R. The left box support section 42L is a section extending from the seat support section 41 to the left side of the seat 11 in order to support the left control box 12L. The bottom plate portion 21 is a portion to which a lower end portion of each of the support sections 41, 42R, and 42L is fixed in order to support the support sections 41, 42R, and 42L from below.

The seat support section 41 includes an installation plate portion 23*b* that is a part of the top plate portion 23 having an upper surface on which the seat 11 is provided and parts of the front plate portion 22 and the connected plate portion 25 which are fixed to the installation plate portion 23*b*.

The right box support section 42R includes a part of the top plate portion 23 which extends rightward from the installation plate portion 23*b*, parts of the front plate portion 22 and the connected plate portion 25 which extend rightward from the seat 11, and the right side frame portion 26R.

Figure 5:
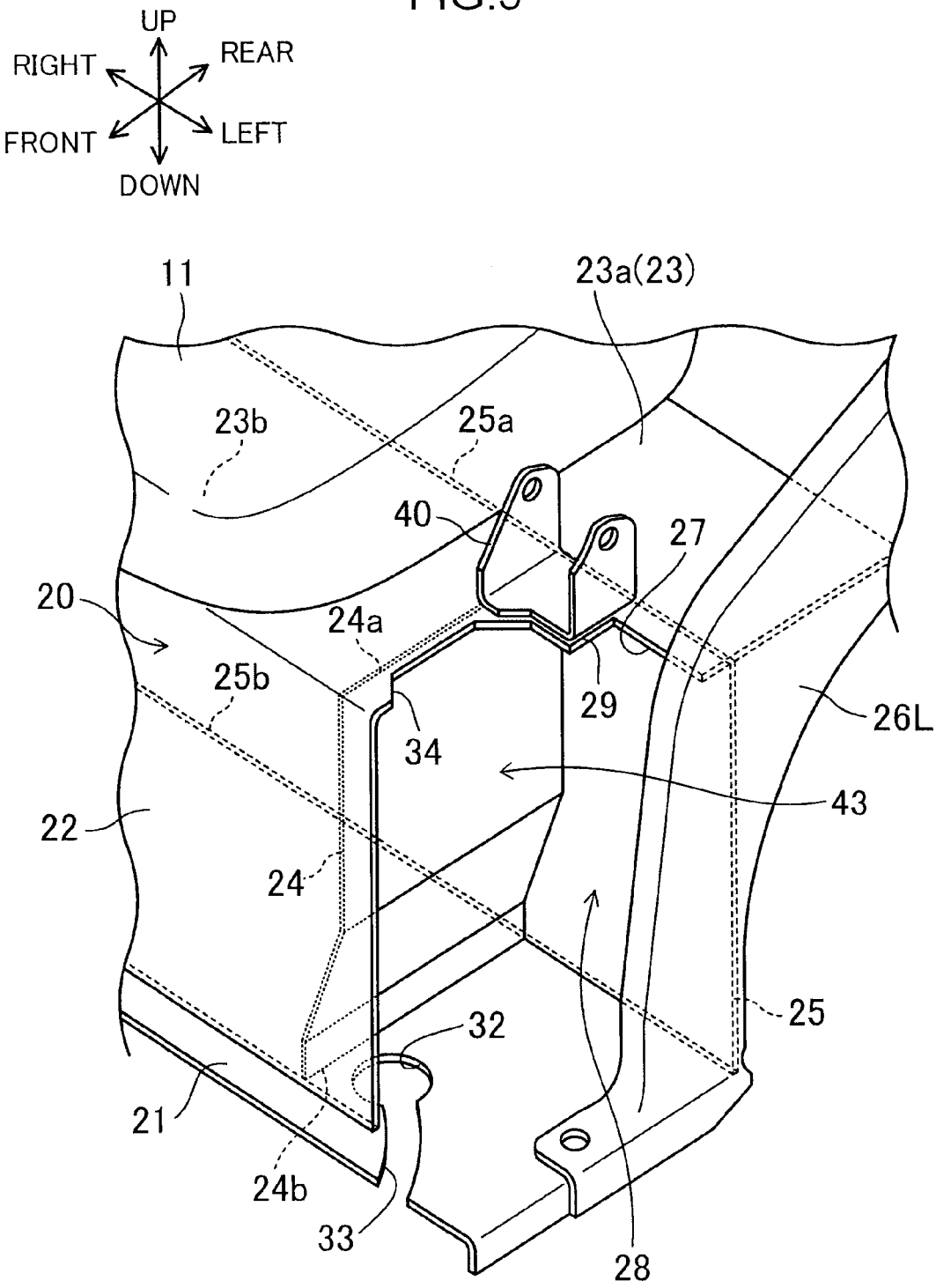
FIG. 5 is a schematic perspective view showing an important part of the seat stand shown in FIG. 4.
Figure 6:
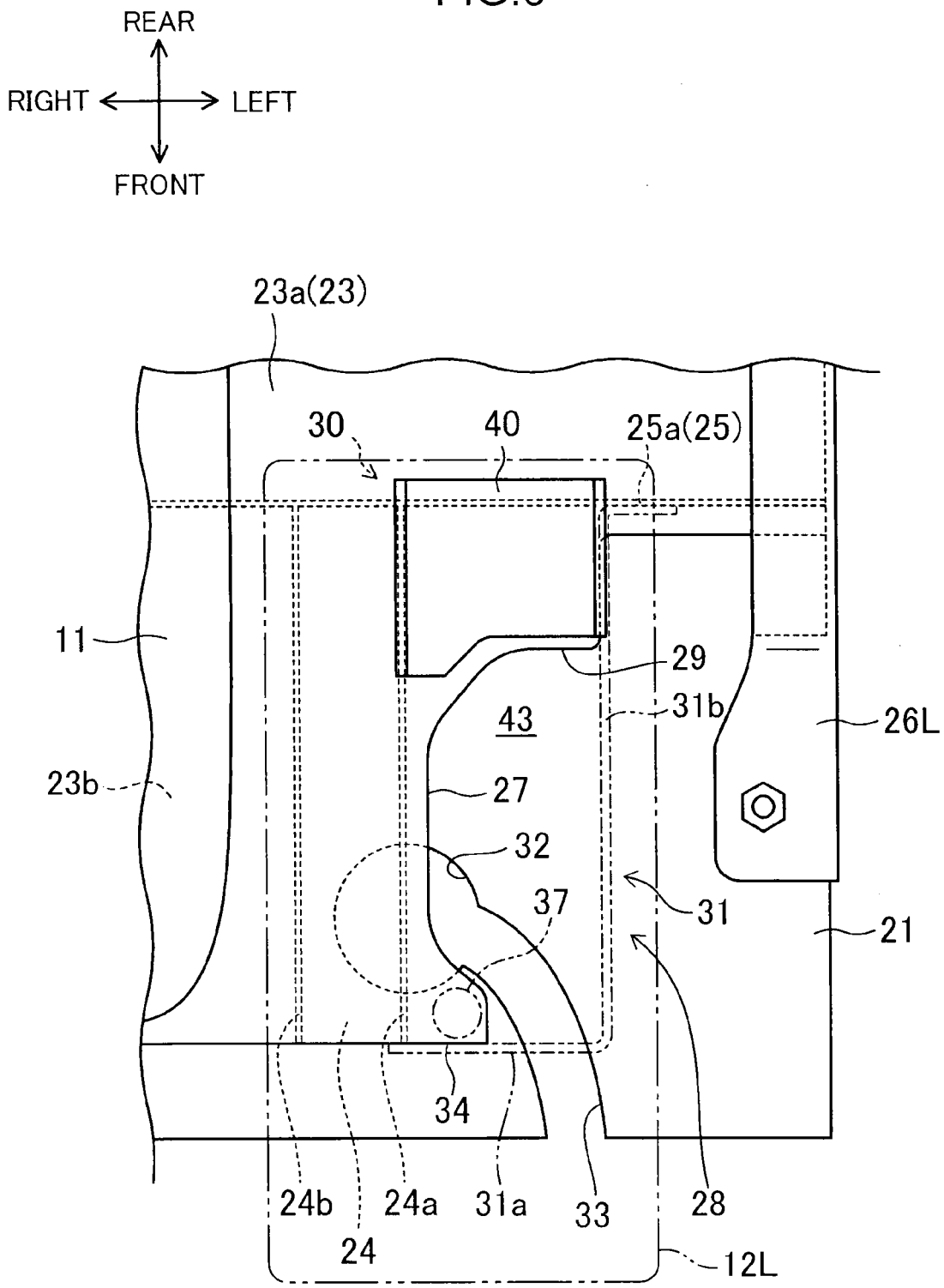
FIG. 6 is a schematic plan view of an important part of the seat stand shown in FIG. 5.

As shown in FIG. 5 and FIG. 6, the left box support section 42L includes an extension portion 23*a* that is a part of the top plate portion 23 which extends to the left side of the seat 11 from the installation plate portion 23*b*, parts of the front plate portion 22 and the connected plate portion 25 which extend leftward from the seat 11, the lower side plate portion 24, and the left side frame portion 26L. The extension portion 23*a* has an upper surface on which the bracket 40 is provided.

Furthermore, an arranging space 43 is provided under the extension portion 23*a* (inside the left box support section 42L) in such a manner that a connection line 38 including at least either hydraulic hose or electric wiring extending from the left control box 12L supported on the extension portion 23*a* is arranged through the arranging space. The arranging space 43 is defined by the lower side plate portion 24, a part of the extension portion 23*a* located on the left side of the lower side plate portion 24, a part of the front plate portion 22 located on the left side of the lower side plate portion 24, a part of the connected plate portion 25 located on the left side of lower side plate portion 24, and a part of the bottom plate portion 21 located on the left side of the lower side plate portion 24. In other words, the lower side plate portion 24, the front plate portion 22, and the connected plate portion 25 correspond to sidewalls covering the arranging space 43 from the side (right, front, and back) thereof.

Moreover, an opening 28 is formed in the left box support section 42L so as to make the arranging space 43 open upward and sideward (forward and leftward). The opening 28 includes a cutout portion 27 formed in the extension portion 23*a* and is formed across the extension portion 23*a* and the front plate portion 22. The cutout portion 27 is a space formed by cutting out a portion of the extension portion 23*a*. The cutout portion 27 penetrates the extension portion 23*a* in the vertical direction and is open sideward (forward and leftward). Furthermore, a left end portion of the front plate portion 22 is cut off over an area ranging from a front end portion of the cutout portion 27 to a lower end portion of the front plate portion 22. Thus, on the left side of the front plate portion 22 and in front of the connected plate portion 25, the opening 28 makes the arranging space 43 open forward and leftward. At the cutout portion 27, the opening 28 makes the arranging space 43 open upward, forward, and leftward.

The cutout portion 27 is a portion formed by cutting out the extension portion 23*a* so as to recess a left end portion of a front edge portion and a front end portion of a left edge portion of the extension portion 23*a* rightward. The cutout portion 27 makes a part of the arranging space 43 open upward, forward, and leftward.

The cutout portion 27 thus formed allows a rear portion of the extension portion 23*a* to project leftward relative to a front portion of the extension portion 23*a*. A left end portion of the rear portion of the extension portion 23*a* is joined to the left side frame portion 26L. A front left portion of the extension portion 23*a* is positioned forward of the left side frame portion 26L.

Furthermore, the extension portion 23*a* has a rear adjacent portion 29 located behind and adjacently to the cutout portion 27. The bracket 40 allowing the left control box 12L to be supported is attached to an area of the upper surface of the extension portion 23*a* which includes the rear adjacent portion 29. In other words, the bracket 40 is located behind and adjacently to the cutout portion 27.

The positional relations between both cutout portion 27 and bracket 40 and both lower side plate portion 24 and connected plate portion 25 will be described below.

The lower side plate portion 24 is located along a right edge of the cutout portion 27 so as to pass through (under) the area to which the bracket 40 is attached (the area in which the left control box 12L is supported). An upper end portion 24*a* of the lower side plate portion 24 is joined to a lower surface of the extension portion 23*a*. A lower end portion 24*b* of the lower side plate portion 24 is joined to an upper surface of the bottom plate portion 21. A front end portion of the lower side plate portion 24 is joined to a rear surface of the front plate portion 22. A rear end portion of the lower side plate portion 24 is joined to the front surface of the connected plate portion 25.

Furthermore, the connected plate portion 25 is arranged along a rear edge of the cutout portion 27 so as to pass through the neighborhood of (under) the bracket 40. An upper end portion 25*a* of the connected plate portion 25 is joined to a lower surface of the top plate portion 23. A lower end portion 25*b* of the connected plate portion 25 is joined to the upper surface of the bottom plate portion 21. A left end portion of the connected plate portion 25 is joined to a right surface of the left side frame portion 26L.

Additionally, the rear end portion of the lower side plate portion 24 is connected to (is in abutting contact with) the intermediate portion of the connected plate portion 25. Specifically, a position (connected position 30) where the upper end portion 24*a* of the lower side plate portion 24 is connected to the connected plate portion 25 is located near the bracket 40. Specifically, the bracket 40 is provided at a position overlapping the connected position 30 in plan view.

As described above, the lower side plate portion 24 and the connected plate portion 25 support the extension portion 23*a* from below. The lower side plate portion 24 and the connected plate portion 25 serve to structurally enhance the strength and rigidity of the left box support section 42L around the opening 28. In particular, since the connected position 30 is positioned near (under) the bracket 40, even when a strong force acts on the bracket 40, the force can be reliably received by both plate portions 24 and 25.

Furthermore, the seat stand 20 further includes a side cover 31 removably installed on the left box support section 42L so as to cover the opening 28 from the side (front and left) thereof. The side cover 31 includes a front plate portion 31*a* extending leftward from the left end portion of the front plate portion 22, and a left plate portion 31*b* extending rearward from the left end portion of the front plate portion 31*a*. A rear surface of a right end portion of the front plate portion 31*a* is fastened to a front surface of the left end portion of the front plate portion 22. Additionally, a rear end portion of the left plate portion 31*b* is fastened to the front surface of the connected plate portion 25.

The side cover 31 is installed on the left box support section 42L to form a gap between the side cover 31 and the extension portion 23*a* which makes the arranging space 43 open upward as shown in FIG. 6. As shown in FIG. 6, the left control box 12L in the operating orientation (shown by a solid line in FIG. 3) has a size enough to be able to cover the entire gap in plan view.

A through-hole 32 penetrating the bottom plate portion 21 in the vertical direction is formed in a part of the bottom plate portion 21 which faces the arranging space 43. The through-hole 32 has a size enough to allow a middle portion of the connection line 38 connected to the left control box 12L to pass through the through-hole 32.

Furthermore, the bottom plate portion 21 is provided with a lead-in groove 33 extending sideward from the through-hole 32 and which is open in a front end surface of the bottom plate portion 21. The lead-in groove 33 has a width dimension enabling the middle portion of the connection line 38 to be inserted into the lead-in groove 33, and also has a planar shape permitting the connection line 38 to be moved so as to be introduced into the arranging space 43 from the side through the cutout portion 27 (opening 28). Specifically, the lead-in groove 33 extends leftward from the through-hole 32 and bends backward and is open in the front end surface of the bottom plate portion 21. The lead-in groove 33 thus formed allows the middle portion of the connection line 38 to be introduced into the through-hole 32 from the front of the bottom plate portion 21 when the connection line 38 is introduced into the arranging space 43 through the through-hole 32.

The extension portion 23*a* includes a front projection portion (reception section) 34 provided to project to the left at a front end portion of the extension portion 23*a*. The front projection portion 34 is located adjacently to a front side of the cutout portion 27.

Figure 7:
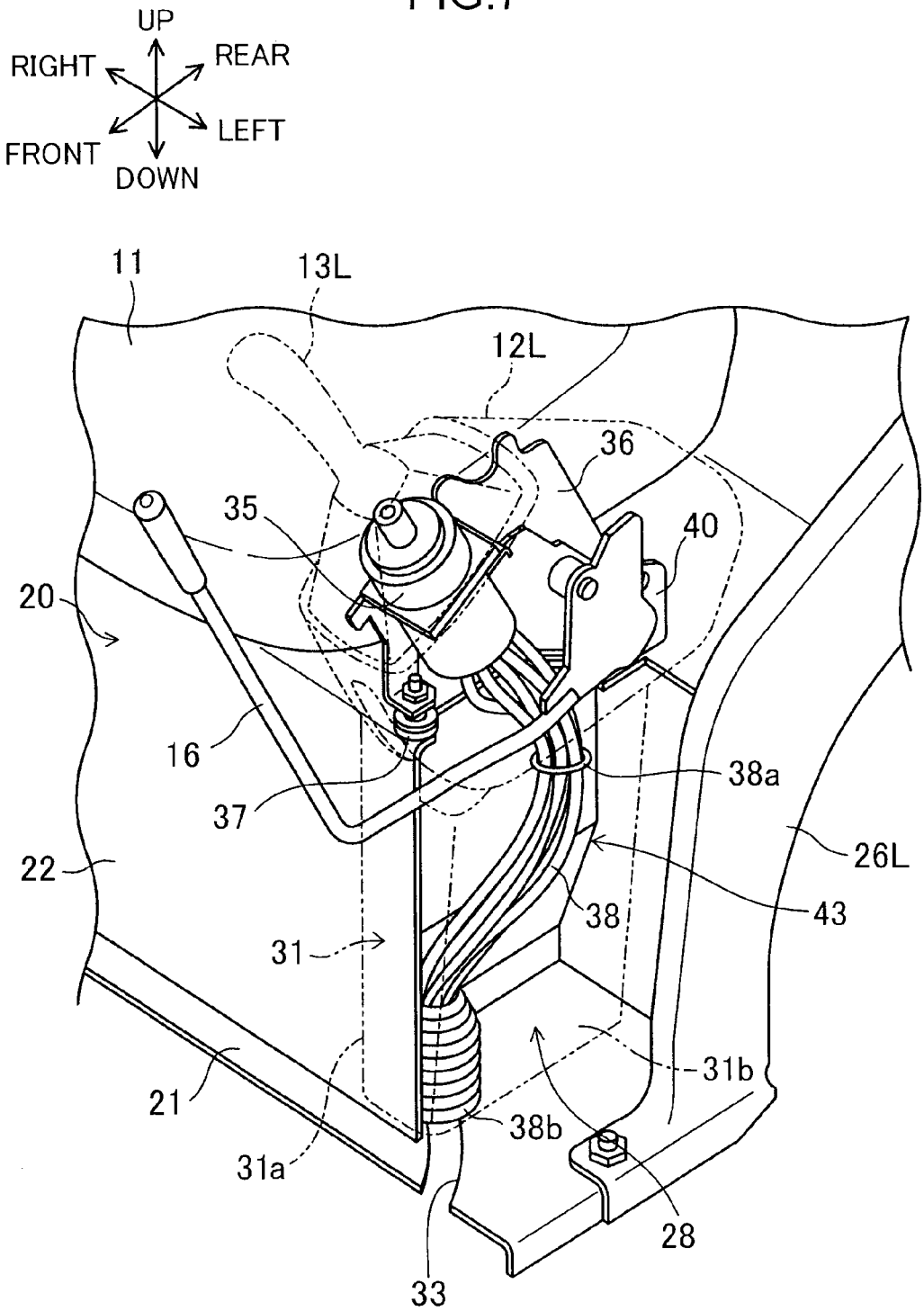
FIG. 7 is a schematic perspective view showing an important part of the seat stand to which the control box has been assembled.

FIG. 7 shows a state where the left control box 12L has been assembled to the seat stand 20.

The left control box 12L is provided with the operating lever 13L. The left control box 12L is internally provided with a hydraulic control apparatus 35 actuated by operating the operating lever 13L and a frame structure 36 that holds the hydraulic control apparatus 35. A rear end portion (base end portion) of the frame structure 36 is rotatably supported with respect to the bracket 40. The hydraulic control apparatus 35 is attached to an intermediate portion of the frame structure 36.

The flip-up lever 16 is also attached to the frame structure 36. As described above, operation of the flip-up lever 16 allows the left control box 12L to be flipped up. An elastic abutting contact portion 37 is provided at a lower end of a front end portion of the frame structure 36.

The abutting contact portion 37 comes into abutting contact with an upper surface of the front projection portion 34 of the extension portion 23*a* when the left control box 12L rotates from the non-operating orientation to the operating orientation. That is, the front projection portion 34 functions as a stopper that receives the front end portion (leading end portion) of the left control box 12L, in other words, the abutting contact portion 37, in order to regulate rotation of the left control box 12L in the operating orientation.

As described above, the rear end portion of the left control box 12L is supported by the extension portion 23*a* via the bracket 40. The intermediate portion of the left control box 12L in the operating orientation is located over the cutout portion 27 (arranging space 43). In other words, the left control box 12L in the operating orientation overlaps the cutout portion 27 in plan view. Furthermore, the front end portion of the left control box 12L in the operating orientation is supported by the front projection portion 34 of the extension portion 23*a*.

The hydraulic control apparatus 35 is connected with a plurality of connection lines 38 introduced into the operation space 10 from the machine room 7 through the underside of the bottom plate portion 21. The connection lines 38 move while being deflected in response to operation of the left control box 12L. Thus, the connection lines 38 need to be loosened so as to be deflected to some degree. Furthermore, the intermediate portion of the connection line 38 is bound together using a binding tool 38*a*. An elastic cover 38*b* covering the periphery of the connection lines 38 is provided over the through-hole 32 in the bottom plate portion 21.

In this case, when the left control box 12L is assembled, operations of connecting, adjusting, and binding the connection lines 38, an operation of installing the elastic cover 38*b*, and the like are also performed. Thus, even when the left control box 12L is compact, if these operations are difficult to perform, much time and effort is needed, making the operations inefficient.

In contrast, the hydraulic shovel 1 allows an assembly operation for the left control box 12L and a arranging operation for the connection lines 38 to be easily performed, resulting in more efficient operations.

Now, the assembly operation for the left control box 12L and the arranging operation for the connection lines 38 will be described.

In the seat stand 20, the cutout portion 27 (opening 28) makes the arranging space 43 open forward and leftward. Thus, the connection lines 38 can be introduced into the arranging space 43 from the side thereof through the cutout portion 27 (opening 28) and easily arranged through the arranging space 43.

In this case, the cutout portion 27 (opening 28) makes the arranging space 43 open upward. Thus, the connection lines 38 can be arranged via the cutout portion 27 (opening 28) in the vertical direction between the arranging space 43 and the left control box 12L, provided over the arranging space 43.

Furthermore, the left control box 12L can be easily assembled to the bracket 40 while the state of the connection lines 38 in the arranging space 43 is being checked from the front and left through the cutout portion 27 (opening 28).

Then, the connection lines 38 can be easily connected to the hydraulic control apparatus 35 of the left control box 12L assembled to the bracket 40 through the cutout portion 27 (opening 28).

Moreover, the connection lines 38 can also be introduced into the through-hole 32 through the lead-in groove 33. Thus, the middle portions of the connection lines can be inserted into the through-hole 32 after the connection lines 38 are connected to the hydraulic control apparatus 35.

The opening 28 is finally covered by the side cover 31 from the side of the opening 28 and covered by the left control box 12L in the operating orientation from above. This prevents the connection lines 38 from being exposed, making the seat stand esthetically appropriate.

Therefore, the seat stand 20 allows the assembly operation for left control box 12L including arranging of the connection lines 38 to be more efficiently performed without impairing the esthetic aspect of the seat stand 20.

As described above, the extension portion 23*a* having the upper surface on which the control box 12L is supported includes the cutout portion 27 penetrating the extension portion 23*a* in the vertical direction and which is open sideward (forward and leftward). Thus, when the control box 12L is mounted on the extension portion 23*a*, the connection lines 38 extending from the control box 12L can be introduced into the cutout portion 27 from the side thereof and arranged through the arranging space 43 provided under the extension portion 23*a*.

This eliminates the need for an operation of threading the connection lines 38 through a through-hole first with the leading end side of the connection lines 38 as in a case where the through-hole is formed in the extension portion 23*a* so as to penetrate the extension portion 23*a* in the vertical direction and peripherally enclosed by the extension portion 23*a*.

Furthermore, since the arranging space 43 is open sideward, the left control box 12L can be mounted on the extension portion 23*a* while the state of the connection lines 38 in the arranging space 43 is being checked from the side of the arranging space 43 through the cutout portion 27.

On the other hand, a working procedure may be employed in which the connection lines 38 are introduced into the arranging space 43 through the cutout portion 27 and then connected to the left control box 12L after the left control box 12L is mounted on the extension portion 23*a*.

Thus, the assembly operation for the left control box 12L including arranging of the connection lines 38 can be more efficiently performed.

Furthermore, the embodiment can exert the following effects.

According to the embodiment, the bracket 40 allows the left control box 12L to be mounted on the left control box support section 42L so as to be rotatable between the operating orientation and the non-operating orientation.

In this case, the left control box 12L positioned in the operating orientation can overlap the cutout portion 27 from above. Thus, the left control box 12L can be utilized as a cover for the cutout portion 27.

According to the embodiment, the front projection portion 34, which is very simply configured, enables both regulated rotation and stable support of the left control box 12L. Furthermore, the front projection portion 34 can receive the leading end portion of the left control box 12L, allowing the left control box 12L in the operating orientation to be stably supported.

According to the embodiment, the lower side plate portion 24 serves to structurally enhance the strength and rigidity of the left control box support section 42L, allowing the left control box 12L to be more stably supported.

According to the embodiment, the weight of the left control box 12L can be reliably received by the lower side plate portion 24, allowing the left control box 12L to be more stably supported.

According to the embodiment, the connected plate portion 25 serves to structurally further increase the strength and rigidity of the left box support section 42L, allowing the left control box 12L to be further stably supported.

According to the embodiment, while the lower side plate portion 24 and the connected plate portion 25, which are connected each other, serve to structurally enhance the strength and rigidity of the left box support section 42L, the support position (bracket 40) for the left control box 12L is provided at the position overlapping the connected position 30 where the connected plate portion 25 and the lower side plate portion 24 cross each other.

Thus, the weight of the left control box 12L can be reliably received by the strength-enhanced portion of the left box support section 42L, allowing the left control box 12L to be more stably supported.

According to the embodiment, while the sidewall (the lower side plate portion 24, the front plate portion 22, and the connected plate portion 25) covers the arranging space 43 from the side thereof to improve the esthetic aspect of the seat stand, the opening 28 makes the arranging space 43 open upward and sideward (forward and leftward) to keep the assembly operation for the left control box 12L efficient.

According to the embodiment, the side cover 31 is mounted to the left box support section 42L after the left control box 12L is mounted on the extension portion 23*a* with the connection lines 38 arranged through the arranging space 43. This allows the connection lines 38 in the arranging space 43 to be covered from the side of the connection lines 38.

This enables improvement of the esthetic aspect of the seat stand 20 after mounting of the left control box 12L.

According to the embodiment, with the left control box 12L mounted on the extension portion 23*a*, the side cover 31 can cover the opening 28 from the side thereof, and the left control box 12L in the operating orientation can cover the gap (the portion through which the arranging space 43 is open upward) between the side cover 31 and the extension portion 23*a* from above.

This enables the arranging space 43 to be blocked from above and from the side of the arranging space 43, allowing further improvement of the esthetic aspect of the seat stand after mounting of the left control box 12L.

According to the embodiment, the seat support section 41 and the left box support section 42L are provided on the bottom plate portion 21. Thus, both support sections 41 and 42L can be assembled to the hydraulic shovel 1 at a time by mounting the bottom plate portion 21 on the support frame 3*a* of the hydraulic shovel 1.

According to the embodiment, the through-hole 32 is formed in the bottom plate portion 21 so as to allow the middle portions of the connection lines 38 to pass through the through-hole 32 in the vertical direction. Thus, the connection lines 38 extending upward from the underside of the bottom plate portion 21 can be arranged while penetrating the bottom plate portion 21 through the through-hole 32.

According to the embodiment, by inserting the middle portions of the connection lines 38 into the lead-in groove 33 from the side of the bottom plate portion 21 and moving the middle portions through the lead-in groove 33, the connection lines 38 can be guided into the through-hole 32 through the lead-in groove 33 without the need to pre-insert the leading end portions of the connection lines 38 into the through-hole 32.

This allows adoption of, for example, a working procedure in which the connection lines 38 are introduced into the through-hole 32 after the leading end portions of the connection lines 38 are attached to the left control box 12L.

The working machine according to the present invention is not limited to the embodiment but includes various other configurations.

For example, the form of the operation space described above is illustrative, and an operation space peripherally enclosed by a wall of a cab can be adopted.

The through-hole 32 and the lead-in groove 33, through which the connection lines 38 are introduced into the arranging space 43, may be formed in the connected plate portion 25 or the lower side plate portion 24 rather than in the bottom plate portion 21.

Furthermore, the lead-in groove 33 may be omitted.

The extension portion 23*a*, a part of the top plate portion 23, has been described. However, the extension portion 23*a* may be formed using a member different from the top plate portion 23.

The left control box 12L has been illustrated as an operating apparatus. However, the operating lever 13L and 13R, the dozer lever 15, the flip-up lever 16, and the like may be adopted as an operating apparatus.

In this case, an operating apparatus support section may be adopted which allows the operating lever 13L and 13R, the dozer lever 15, the flip-up lever 16, and the like to be supported at the side of the seat 11 with no use of the control box.

The specific embodiment described above mainly includes inventions having the following configurations.

In order to solve the problem, the present invention provides a seat stand configured to support, at a side of a seat, an operating apparatus causing a working apparatus provided in a working machine to be operated, the seat stand including a seat support section having an installation plate portion including an upper surface on which the seat is provided and an operating apparatus support section extending from the seat support section to the side of the seat and configured to support the operating apparatus, wherein the operating apparatus support section has an extension portion extending sideward from the installation plate portion and having an upper surface configured to support the operating apparatus thereon, an arranging space is provided under the extension portion in such a manner that a connection line extending from the operating apparatus supported on the extension portion is arranged through the arranging space, and a cutout portion, formed in the extension portion, penetrates the extension portion in a vertical direction, and is open sideward.

According to the present invention, the extension portion having the upper surface allowing the operating apparatus to be supported includes the cutout portion penetrating the extension portion in the vertical direction and which is open sideward. Thus, when the operating apparatus is mounted on the extension portion, the connection line extending from the operating apparatus can be introduced into the cutout portion from the side thereof and arranged through the arranging space provided under the extension portion.

This eliminates the need for an operation of threading the connection line through a through-hole first with the leading end side of the connection line as in a case where the through-hole is formed in the extension portion so as to penetrate the extension portion in the vertical direction and peripherally enclosed by the extension portion.

Furthermore, since the arranging space is open sideward, the operating apparatus can be mounted on the extension portion while the state of the connection line in the arranging space is being checked from the side of the arranging space through the cutout portion.

On the other hand, a working procedure may be employed in which the connection line is introduced into the arranging space through the cutout portion and then connected to the operating apparatus after the operating apparatus is mounted on the extension portion.

Thus, according to the present invention the assembly operation for the operating apparatus including arranging of the connection line can be more efficiently performed.

In the present invention, the connection line includes at least either hydraulic hose or electric wiring.

In the present invention, the cutout portion is a space formed by cutting out a portion of the extension portion.

In the seat stand, the extension portion is preferably provided with a bracket configured to support a base end portion of the operating apparatus in such a manner that the operating apparatus is rotatable between a basic orientation in which the operating apparatus overlaps the cutout portion from above and a stand-up orientation in which a leading end portion of the operating apparatus is moved upward relative to the basic orientation.

According to this aspect, the bracket allows the operating apparatus to be mounted on an operating apparatus support section so as to be rotatable between the basic orientation and the stand-up orientation.

In this case, the operating apparatus positioned in the basic orientation can overlap the cutout portion. Thus, when a relatively large control box is adopted, the control box can be utilized as a cover for the cutout portion.

In the seat stand, the extension portion preferably includes a reception section receiving the leading end portion of the operating apparatus positioned in the basic orientation in order to regulate rotation of the operating apparatus in the basic orientation.

According to this aspect, the reception section, which is very simply configured, enables both regulated rotation and stable support of the operating apparatus. Specifically, the reception section receives the leading end portion of the operating apparatus, allowing the operating apparatus in the operating orientation to be reliably supported.

In the seat stand, the operating apparatus support section preferably further has a lower side plate portion connected to a lower surface of the extension portion in order to support the extension portion from below.

According to this aspect, the lower side plate portion serves to structurally enhance the strength and rigidity of the operating apparatus support section, allowing the operating apparatus to be more stably supported.

In the seat stand, a support position on the extension portion where the operating apparatus is supported is preferably set at a position overlapping the lower side plate portion in plan view.

According to this aspect, the weight of the operating apparatus can be reliably received by the lower side plate portion, allowing the operating apparatus to be more stably supported.

In the seat stand, the operating apparatus support section preferably further has a connected plate portion connected to the lower surface of the extension portion in order to support the extension portion from below, extending along a direction crossing the lower side plate portion in plan view, and connected to the lower side plate portion.

According to this aspect, the connected plate portion serves to structurally further increase the strength and rigidity of the operating apparatus support section, allowing the operating apparatus to be further stably supported.

Furthermore, when the support position on the extension portion where the operating apparatus is supported is set at the position overlapping the lower side plate portion in plan view, preferably the operating apparatus support section further has a connected plate portion connected to the lower surface of the extension portion in order to support the extension portion from below, extending along a direction crossing the lower side plate portion in plan view, and connected to the lower side plate portion, and the support position on the extension portion where the operating apparatus is supported is provided at a position overlapping a connected position where the lower side plate portion and the connected plate portion are connected each other in plan view.

According to this aspect, while the lower side plate portion and the connected plate portion, which extend along directions crossing each other, serve to structurally enhance the strength and rigidity of the operating apparatus support section, the support position for the operating apparatus is provided at the position overlapping the connected position where the connected plate portion and the lower side plate portion are connected each other.

Thus, the weight of the operating apparatus can be reliably received by the strength-enhanced portion of the operating apparatus support section, allowing the operating apparatus to be more stably supported.

In the seat stand, preferably the operating apparatus support section further includes a sidewall covering the arranging space from a side of the arranging space and has an opening formed across the extension portion and the sidewall, the opening including the cutout portion and making the arranging space open upward and sideward.

According to this aspect, while the sidewall covers the arranging space from the side thereof to improve the esthetic aspect of the seat stand, the opening makes the arranging space open upward and sideward so that the assembly operation for the operating apparatus can be kept efficient.

The seat stand preferably further includes a side cover that is able to be mounted to the operating apparatus support section so as to cover the opening from a side of the opening.

According to this aspect, the connection line in the arranging space can be covered from the side of the connection line by mounting the side cover to the operating apparatus support section after the operating apparatus is mounted on the extension portion with the connection line arranged through the arranging space.

This improves the esthetic aspect of the support structure after mounting of the operating apparatus.

In the seat stand, the extension portion is provided with a bracket configured to support a base end portion of the operating apparatus in such a manner that the operating apparatus is rotatable between a basic orientation in which the operating apparatus overlaps the cutout portion from above and a stand-up orientation in which a leading end portion of the operating apparatus is moved upward relative to the basic orientation, the operating apparatus support section further includes a sidewall covering the arranging space from a side of the arranging space and has an opening formed across the extension portion and the sidewall, the opening including the cutout portion and making the arranging space open upward and sideward, the seat stand further includes a side cover that is able to be mounted to the operating apparatus support section so as to cover the opening from a side of the opening, and the operating apparatus in the basic orientation has a size enough to be able to entirely cover a gap between the side cover and the extension portion in plan view.

According to this aspect, with the operating apparatus mounted on the extension portion, the opening is covered by the side cover from the side of the opening, and the gap between the side cover and the extension portion (the portion making the arranging space open upward) can be covered by the operating apparatus in the basic orientation from above.

Thus, the arranging space can be blocked from above and from the side of the arranging space, allowing the esthetic aspect of the seat stand to be further improved after muting of the operating apparatus.

Preferably, the seat stand further includes a bottom plate portion to which lower end portions of the seat support section and the operating apparatus support section are fixed, and a through-hole is formed in the bottom plate portion so as to allow a middle portion of the connection line to pass through the through hole in the vertical direction.

According to this aspect, since the seat support section and the operating apparatus support section are provided on the bottom plate portion, both support sections can be assembled to the working machine at a time by mounting the bottom plate portion to a frame of the working machine.

In this case, the connection line may be arranged to the side of the seat through a space under the bottom plate portion.

Thus, according to this aspect, a through-hole is formed in the bottom plate portion so as to allow the middle portion of the connection line to pass through the through-hole in the vertical direction.

This allows the connection line extending upward from the underside of the bottom plate portion to be arranged while penetrating the bottom plate portion through the through-hole.

In the seat stand, preferably, the bottom plate portion is provided with a lead-in groove extending sideward from the through-hole and which is open in a side end surface of the bottom plate portion, and the lead-in groove has a width dimension enabling the middle portion of the connection line to be inserted into the lead-in groove, and also has a planar shape permitting the connection line to be moved so as to be introduced into the arranging space from the side.

According to this aspect, by inserting the middle portion of the connection lines into the lead-in groove from the side of the bottom plate portion and moving the middle portion through the lead-in groove, the connection line can be guided into the through-hole through the lead-in groove without the need to pre-insert the leading end portion of the connection line into the through-hole.

This allows adoption of, for example, a working procedure in which the connection line is introduced into the through-hole after the leading end portion of the connection line is connected to the working apparatus. As a result, the operation can be more efficiently performed.

Furthermore, the present invention provides a working machine including a working apparatus, an operating apparatus allowing the working apparatus to be operated, and a seat stand supporting the operating apparatus at a side of a seat.

This application is based on Japanese Patent application No. 2013-124383 filed in Japan Patent Office on Jun. 13, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A seat stand configured to support, at a side of a seat, an operating apparatus causing a working apparatus provided in a working machine to be operated, the seat stand comprising:

a seat support section having an installation plate portion including an upper surface on which the seat is provided; and an operating apparatus support section extending from the seat support section to the side of the seat and configured to support the operating apparatus, wherein the operating apparatus support section has an extension portion extending sideward from the installation plate portion and having an upper surface configured to the operating apparatus thereon, an arranging space is provided under the extension portion in such a manner that a connection line extending from the operating apparatus supported on the extension portion is arranged through the arranging space, a cutout portion, formed in the extension portion, penetrates the extension portion in a vertical direction and is open sideward, and the extension portion is provided with a bracket configured to support a base end portion of the operating apparatus such that the operating apparatus is rotatable between a basic orientation in which the operating apparatus overlaps the cutout portion from above and a stand-up orientation in which a leading end portion of the operating apparatus is moved upward relative to the basic orientation.

2. The seat stand according to claim 1, wherein the extension portion comprises a reception section receiving the leading end portion of the operating apparatus positioned in the basic orientation in order to regulate rotation of the operating apparatus in the basic orientation.

3. The seat stand according to claim 1, wherein the operating apparatus support section further comprises a lower side plate portion connected to a lower surface of the extension portion in order to support the extension portion from below.

4. The seat stand according to claim 3, wherein the operating apparatus support section further comprises a connected plate portion connected to the lower surface of the extension portion in order to support the extension portion from below, extending along a direction crossing the lower side plate portion in plan view, and connected to the lower side plate portion.

5. The seat stand according to claim 1, wherein the operating apparatus support section further includes a sidewall covering the arranging space from a side of the arranging space, and the operating apparatus support section has an opening formed across the extension portion and the sidewall, the opening including the cutout portion and making the arranging space open upward and sideward.

6. The seat stand according to claim 1, wherein the operating apparatus support section further has a sidewall covering the arranging space from a side of the arranging space, the operating apparatus support section has an opening formed across the extension portion and the sidewall, the opening including the cutout portion and making the arranging space open upward and sideward, the seat stand further has a side cover that is able to be mounted to the operating apparatus support section so as to cover the opening from a side of the opening, and the operating apparatus in the basic orientation has a size large enough to be able to entirely cover a gap between the side cover and the extension portion in plan view.

7. A working machine comprising:

a working apparatus;

an operating apparatus for operating the working apparatus; and a seat stand supporting the operating apparatus at a side of a seat according to claim 1.

8. A seat stand configured to support, at a side of a seat, an operating apparatus causing a working apparatus provided in a working machine to be operated, the seat stand comprising:

a seat support section having an installation plate portion including an upper surface on which the seat is provided; and an operating apparatus support section extending from the seat support section to the side of the seat and configured to support the operating apparatus, wherein the operating apparatus support section has an extension portion extending sideward from the installation plate portion and having an upper surface configured to support the operating apparatus thereon, an arranging space is provided under the extension portion in such a manner that a connection line extending from the operating apparatus supported on the extension portion is arranged through the arranging space, and a cutout portion, formed in the extension portion, penetrates the extension portion in a vertical direction and is open sideward, the operating apparatus support section further comprises a lower side plate portion connected to a lower surface of the extension portion in order to support the extension portion from below, and a support position on the extension portion where the operating apparatus is supported is set at a position overlapping the lower side plate portion in plan view.

9. The seat stand according to claim 8, wherein the operating apparatus support section further comprises a connected plate portion connected to the lower surface of the extension portion in order to support the extension portion from below, extending along a direction crossing the lower side plate portion in plan view, and connected to the lower side plate portion, and the support position on the extension portion where the operating apparatus is supported is provided at a position overlapping a connected position where the lower side plate portion and the connected plate portion are connected each other in plan view.

10. A seat stand configured to support, at a side of a seat, an operating apparatus causing a working apparatus provided in a working machine to be operated, the seat stand comprising:

a seat support section having an installation plate portion including an upper surface on which the seat is provided; and an operating apparatus support section extending from the seat support section to the side of the seat and configured to support the operating apparatus, wherein the operating apparatus support section has an extension portion extending sideward from the installation plate portion and having an upper surface configured to support the operating apparatus thereon, an arranging space is provided under the extension portion in such a manner that a connection line extending from the operating apparatus supported on the extension portion is arranged through the arranging space, a cutout portion, formed in the extension portion, penetrates the extension portion in a vertical direction and is open sideward, the operating apparatus support section further includes a sidewall covering the arranging space from a side of the arranging space, and an opening formed across the extension portion and the sidewall, the opening including the cutout portion and making the arranging space open upward and sideward, and the seat stand further comprises a side cover that is able to be mounted to the operating apparatus support section so as to cover the opening from a side of the opening.

11. A seat stand configured to support, at a side of a seat, an operating apparatus causing a working apparatus provided in a working machine to be operated, the seat stand comprising:

a seat support section having an installation plate portion including an upper surface on which the seat is provided; and an operating apparatus support section extending from the seat support section to the side of the seat and configured to support the operating apparatus, wherein the operating apparatus support section has an extension portion extending sideward from the installation plate portion and having an upper surface configured to support the operating apparatus thereon, an arranging space is provided under the extension portion in such a manner that a connection line extending from the operating apparatus supported on the extension portion is arranged through the arranging space, a cutout portion, formed in the extension portion, penetrates the extension portion in a vertical direction and is open sideward, the seat stand further comprises a bottom plate portion to which lower end portions of the seat support section and the operating apparatus support section are fixed, and a through-hole is formed in the bottom plate portion so as to allow a middle portion of the connection line to pass through the through hole in a vertical direction.

12. The seat stand according to claim 11, wherein the bottom plate portion is provided with a lead-in groove which extends sideward from the through-hole and which is open in a side end surface of the bottom plate portion, and the lead-in groove has a width dimension enabling the middle portion of the connection line to be inserted into the lead-in groove, and also has a planar shape permitting the connection line to be moved so as to be introduced into the arranging space from the side.

* * * * *